United States Patent [19]

Wahnschaff

[11] 4,262,626

[45] Apr. 21, 1981

[54] GLUER LOCKDOWN

[76] Inventor: Paul Wahnschaff, 3202 Marjan Dr., Atlanta, Ga. 30340

[21] Appl. No.: 111,530

[22] Filed: Jan. 14, 1980

[51] Int. Cl.[3] ..... B05C 1/02

[52] U.S. Cl. ..... 118/247; 118/249; 118/262

[58] Field of Search ..... 118/245, 262, 249, 203, 118/204, 261, 259, 258, 247; 101/247, 352; 15/256.51; 271/273, 274

[56] References Cited

U.S. PATENT DOCUMENTS

| | | | |
|---|---|---|---|
| 1,143,385 | 6/1915 | Haberle et al. | 118/203 |
| 1,741,412 | 12/1929 | Federwitz | 118/70 |
| 1,818,198 | 8/1931 | Davis | 118/245 X |
| 2,053,730 | 9/1936 | Minkow | 118/245 |
| 3,433,155 | 3/1969 | Norton | 118/262 X |
| 4,119,057 | 10/1978 | Wahnschaff | 118/203 |
| 4,137,597 | 2/1979 | Achenbach et al. | 15/256.51 |

*Primary Examiner*—John P. McIntosh
*Attorney, Agent, or Firm*—Jones, Thomas & Askew

[57] ABSTRACT

The shaft of a lockdown assembly is supported at its ends in the side sections of the stationary frame of a glue applicator. Lockdown legs are mounted to the shaft at each end of the shaft and extend parallel to each other from the shaft toward engagement with the side sections of the movable frame of the glue applicator. A spring biases the lockdown legs toward their locked positions. The shaft can be pivoted to raise the lockdown legs away from the movable frame, the movable frame tilted so as to lift its rolls away from their operating positions with respect to the rolls of the stationary frame, and a hook of one of the lockdown legs engages a catch on one of the side sections of the movable frame to hold the movable frame in its open position.

7 Claims, 5 Drawing Figures

GLUER LOCKDOWN

BACKGROUND OF THE INVENTION

This invention relates to coating apparatus wherein a solid applicator roll contacts the work, with the applicator roll being movable between operative positions and open positions. More particularly, this invention relates to a glue applicator of the type used to apply liquid glue to sheet material, such as to blanks which are ultimately formed into paper boxes, with the blanks being processed between rotatable rolls, with certain ones of the rolls being locked into their operative positions during the operation of the glue applicator and movable from their locked positions to opened positions for maintenance when the operation of the glue applicator has been terminated.

Prior glue applicator equipment has been developed for the purpose of feeding sheets of material in sequence to a series of processing stations and coating the sheet material with glue and other liquids at one of the processing stations. As illustrated in my U.S. Pat. No. 4,119,057, these machines typically include equipment for picking off the end sheet from a stack of sheet material, feeding the sheet along a path generally parallel to the plane of the sheet material past a rotating cylindrical glue applicator roll, and then to various subsequent work stations. The glue applicator roll usually continuously rotates in contact with a wetting roll which is partially submerged in the body of liquid glue or other liquid.

The equipment is constructed so that its various processing rolls can be separated from one another, from their usual operating positions to an open position. This permits the operator to extract misaligned sheet material and other items from between the rolls when the equipment malfunctions, and to clean or otherwise maintain the equipment. Certain ones of the rolls are mounted at their ends in rotatable relationship with respect to a stationary frame while other ones of the rolls are mounted at their ends in rotatable relationship with respect to a movable frame. When the movable frame is in its operating position, it is desirable to lock it in its operating position so that various vibrations encountered by the equipment during its normal operating function do not tend to jar the rolls apart and cause the rolls to improperly feed the sheet material.

The prior art equipment has utilized various lock pin arrangements where, for example, a lock pin is inserted through aligned openings of the movable frame and the stationary frame when the movable frame is in its operating position. While the prior art lock pin arrangement assists to some extent in reducing the effect of vibration of the movable frame and its rolls, extended use of the equipment and the continuous vibration of the equipment eventually causes the lock pin and its holes to wear, resulting in a loose connection and therefore permitting increased vibrations between the movable frame and the stationary frame. This increases the likelihood of malfunction of the equipment.

SUMMARY OF THE INVENTION

Briefly described, the present invention comprises a lockdown assembly for a gluer which positively locks down both side sections of the movable frame of the gluer with respect to the stationary frame in the roll section of the gluer. The lockdown assembly includes an elongated rectilinear shaft rotatably supported at its opposite ends in the side sections of the stationary frame, and lock legs mounted at each end of the shaft and rotatable with the shaft into locking engagement with respect to the side sections of the movable frame to hold the movable frame and its rolls in their operating positions with respect to the stationary frame and its rolls. The lock legs are adjustable in length so that each leg can be adjusted independently of the other leg so as to compensate for wear during the life of the gluer, and a spring is arranged to bias the lock legs toward their locked positions. The lockdown assembly further includes a hook member that is arranged to engage a hook catch on one side section of the movable frame, so that when the movable frame is opened away from the stationary frame, the hook member engages the catch and holds the movable frame in its opened position.

Thus, it is an object of this invention to provide an improved lockdown assembly for the roll section of a gluer which functions to reliably lock the movable frame in its operating position, at both side sections of the frame.

Another object of this invention is to provide a lockdown asembly for a gluer which is easy to operate, which is reliable to positively lockdown the movable frame with respect to the stationary frame in the roll section of the gluer, and which can be adjusted to compensate for wear during the life of the gluer.

Other objects, features and advantages of the present invention will become apparent upon reading the following specification, when taken in conjunction with the accompanying drawings.

DETAILED DESCRIPTION

Figure 1:
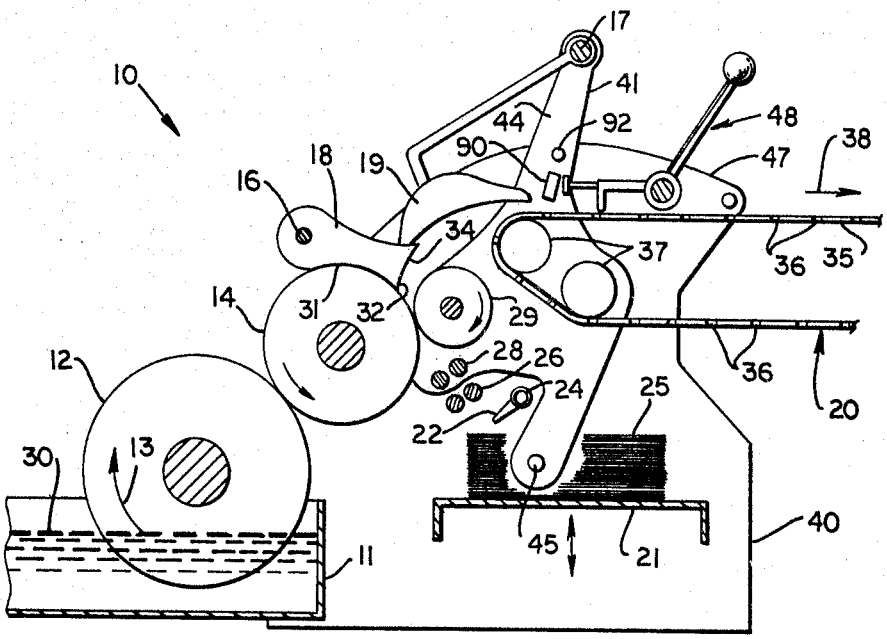
FIG. 1 is a schematic side elevational view of a portion of the gluer showing the roll section of the gluer.

Referring now in more detail to the drawings, in which like numerals indicate like parts throughout the several views, FIG. 1 illustrates the roll section of a gluer 10 which includes a glue supply pan 11, a glue wetting roll 12, a cylindrical glue applicator roll 14, pick finger support bar 16, a plurality of pick fingers 18, guide cams 19, and vacuum conveyor assembly 20. Sheet supply platform 21 is located at an elevation lower than the cylindrical applicator roll 14 and is moved up and down in timed relationship toward and away from the suction fingers 22. The suction fingers 22 are mounted on a suction tube 24 which oscillates or rotates in timed relationship with the system to pick up the upper-most sheet 25 from the platform 21 and move the upper-most sheet between the pairs of feed rolls 26 and 28. Various guide plates and guide fingers (not shown) are used to help direct the leading edge of the sheet 25 to and beyond the pairs of feed rolls 26 and 28. The sheets are directed between the glue applicator roll 14 and presser roll 29. The glue wetting roll 12 which is partially submerged in the liquid glue 30 in pan 11 rotates with a surface speed approximately equal to the surface speed of glue applicator roll 14 in the direction indicated by arrow 13 so as to wet the glue applicator roll with glue. When the sheet 25 passes in contact with the glue applicator roll 14 it becomes coated with glue.

Each of the pick fingers 18 includes a curved lower edge 31 which is in close juxaposition with respect to the upper curved surface of the cylindrical glue applicator roll 14 and a pointed end 32 which faces the oncoming sheet material. As the sheet material moves past the line of contact between the presser roll 29 and the glue applicator roll 14, the pointed end 32 of each pick finger 18 picks the leading edge of the sheet material away from the glue applicator roll 14, and the upwardly extending edge 34 of each of the pick fingers tends to deflect the oncoming edge upwardly toward the guides 19, and the guides 19 further deflect the sheet material on toward the suction conveyor 20. The upwardly extending edge 34 of each pick finger 18 as well as the contacting surfaces of the guides 19 usually are formed with a curvature that compliments the shape of the adjacent portion of the suction conveyor 20.

Suction conveyor 20 includes a conveyor belt 35 with a plurality of apertures 36 formed therein, and the belt moves in the direction indicated by arrow 38. The inlet of a blower (not shown) communicates with the bottom surface of the upper flight of conveyor belt 35 so as to induce a flow of air through the upper flight of the conveyor through openings 36. This tends to cause the sheets of material being fed through the system to cling to the upper flight of the belt conveyor as the upper flight moves in the direction indicated by arrow 38 away from the roll section of gluer 10.

Gluer 10 comprises a stationary frame 40 and a movable frame 41. Stationary frame 40 comprises a pair of spaced apart sections 46 and 47, while movable frame 41 comprises a pair of spaced apart sections 42 and 44. Sections 42 and 44 of movable frame 41 are spaced just inside the sections of the stationary frame 40. Movable frame 41 is pivotably mounted to stationary frame 40 by means of lower pivot pins 45 at each side of the frame assembly.

Stationary frame 40 supports glue wetting roll 12, applicator roll 14, pick finger support bar 16 and the first pair feed rolls 26. The rolls 12, 14 and 26 are rotatably supported at their ends in the stationary frame, and drive means are connected to each of the rolls so that they are driven in timed relationship with respect to one another. Movable frame 41 supports presser roll 29, the second pair of feed rolls 28, conveyor guide rolls 37, and support shaft 17 of guide cams 19. These elements are supported at their ends by side sections 42 and 44 of movable frame 41 and drive means are connected to each of these rolls so that they are driven in timed relationship with respect to one another and with respect to the rolls of the stationary frame. Pivot pin 45 is located to one side of the center of gravity of movable frame 41, tending to cause the movable frame to rotate counterclockwise (FIG. 1) until presser roll 29 engages applicator roll 14.

Figure 2:
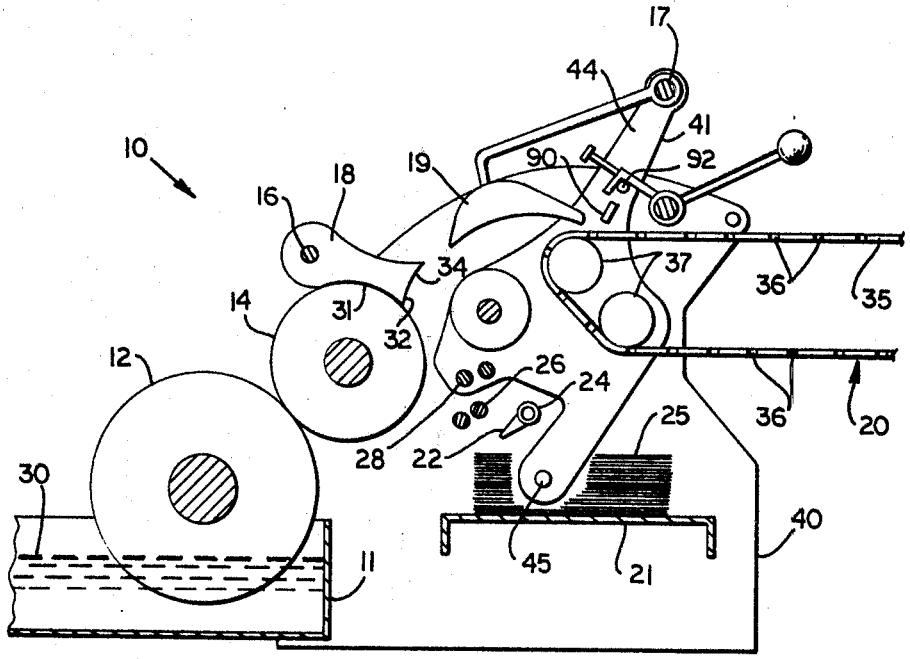
FIG. 2 is also a schematic side elevational view of the roll section of the gluer, similar to FIG. 1, but showing the movable frame moved to its opened position.

Movable frame 41 is movable with respect to stationary frame 40 about pivot pins 45 from the closed or operating position as illustrated in FIG. 1 to the opened position as illustrated in FIG. 2. When the movable frame 41 is titled open in this manner, cam guides 19, conveyor 20, feed rolls 28 and presser rolls 29 are moved away from wetting roll 12 and applicator roll 14 and pickers 18, thus opening the machine to permit the operator to extract misaligned sheets of material or to otherwise adjust the equipment.

Figure 3:
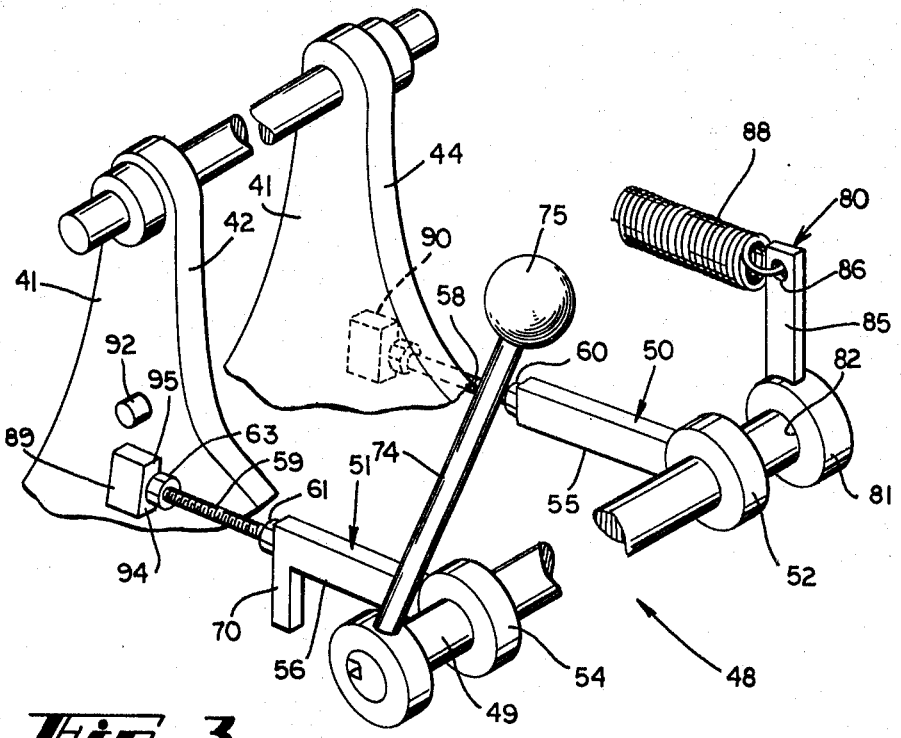
FIG. 3 is a partial perspective illustration of the lockdown assembly holding the movable frame in its operating position.
Figure 4:
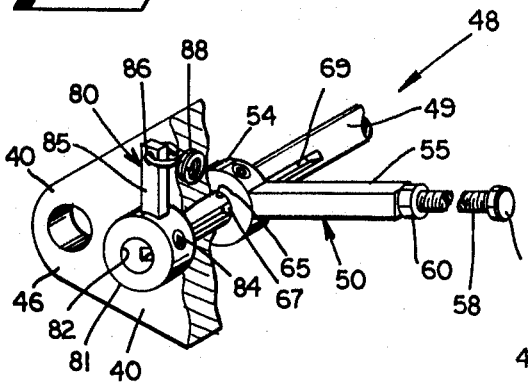
FIG. 4 is a detail perspective illustration of the spring end of the lockdown assembly.
Figure 5:
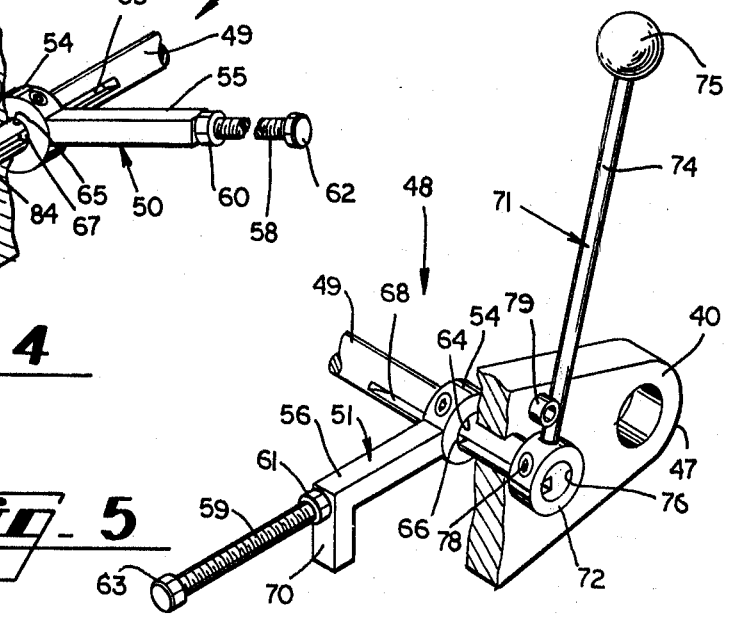
FIG. 5 is a detail perspective illustration of the handle end of the lockdown assembly.

As illustrated in FIGS. 3–5, gluer lockdown assembly 48 comprises rectilinear shaft 49 extending parallel to rolls 12, 14, 26, 28, etc., of the roll section of the gluer, with shaft 49 being rotatably supported at its ends by stationary frame 40. Lock legs 50 and 51 are mounted to shaft 49. Each lock leg 51 includes, respectively, a socket 52, 54, leg 55, 56, externally threaded extension 58, 59, lock nut, 60, 61 and extension head 62, 63. The legs 55, 56 extend parallel to each other and normal with respect to the length of shaft 49. Each socket 52, 54 includes a central opening 64, 65 and a protrusion 66, 67 extending inwardly of the socket opening. Alignment slots 68, 69 are formed in the ends of shaft 49, with the slots 68, 69 being in alignment with one another. The protrusions 66, 67 of the sockets 52, 54 extend into slots 68, 69 so as to align lock legs 50 and 51 with one another at opposite ends of shaft 49. Projection 70 is connected to the distal end of leg 56, and extends normal to leg 56. Projection 70 functions as a hook in a manner to be described hereinafter. Legs 55 and 56 each define an internally threaded bore, and externally threaded extensions 58, 59 are threaded into each bore, with the lock nut 60, 61 locking its extension in fixed position with respect to legs 55 and 56.

Handle 71 is conncted to one end of shaft 49. Handle 71 comprises socket 72, lever 74 and knob 75. The opening 76 of socket 72 surrounds the protruding end of shaft 49, and set screw 78 extends through an internally threaded opening of the socket 72 into engagement with the end of shaft 49 to lock handle 79 to shaft 49. Screw 79 is threaded into an internally threaded bore of stationary frame 40 at a position above socket 72 of handle 71, in the path of handle lever 74, to limit rotation of handle lever 74 and lockdown assembly 48.

Spring assembly 80 is mounted on shaft 49 at the end of the shaft opposite to handle 71. Spring assembly 80 includes socket 81 defining an internal opening 82 mounted on the end of shaft 49, with set screw 84 extending through an internally threaded opening of socket 81 to lock the socket to the shaft 49. Spring lever 85 protrudes radially from socket 81 and defines spring opening 86 at its distal end. Coil tension spring 88 is connected at one of its ends to spring lever 85 through opening 86 and at its other end (not shown) to stationary frame 40. Spring 88 thereby biases lockdown assembly 48 to the position indicated in FIGS. 1 and 3.

Lockdown bearing blocks 89 and 90 are mounted on the outside surfaces of the side sections 42 and 44 of movable frame 41, and hook protrusion 92 is mounted to side section 42 of movable frame 41 above bearing block 89. Each bearing block 89 and 90 includes a bearing surface 94 which faces lockdown shaft 49 and which is arranged to have an extension head 62, 63 of a lock leg 50, 51 bear thereagainst. The upper portion 95 of each bearing surface is beveled so as to form a cam surface for the extension heads 62 and 63 as they move in a downward arc toward their down and locked positions.

When lockdown assembly 48 is moved to the position illustrated in FIGS. 1 and 3, the movable frame 41 is locked in its operating position and its rolls coact with the rolls of the stationary frame 40 to move the sections of sheet material sequentially through the gluer, to apply the glue to the sections of sheet material and move the glued sections on beyond the gluer. When the operator desires to open the gluer, the operator rotates shaft 49 by pulling lever 71 which rotates lock legs 50 and 51 in an upward arc, thus lifting the extension heads 62 and 63 out of engagement with the bearing surface 94 of the lockdown bearing blocks 89 and 90. The operator then pulls the movable frame 41, usually by grasping one of the upwardly extending protrusions of the frame, and the movable frame tends to rotate about its pivot pins 45 from its closed and operating position (FIGS. 1 and 3) to its open position (FIG. 2). The operator then permits handle 71 to move under the influence of its coil tension spring 88 back toward its original position, whereupon its hook projection 70 extends about the hook catch 92. Thus, the movable frame 41 is held in its tilted open position until the operator is ready to close the movable frame back to its operating position.

While this invention has been described in detail with particular reference to preferred embodiments thereof, it will be understood that variations and modifications can be effected within the spirit and scope of the invention as described hereinbefore and as defined in the appended claims.

I claim:

1. An apparatus for applying glue and the like to sheet-like material comprising a wetting roll, and applicator roll for receiving glue from said wetting roll, a presser roll for rolling engagement with said applicator roll, feed roll for feeding sheet material between said presser roll and said applicator roll, at least one conveyor roll with a conveyor belt extending thereabout for receiving the sheet material from said applicator roll, and pick means for directing the sheet material from said applicator roll to said conveyor belt, a stationary frame including spaced side sections, said wetting roll and said applicator roll being mounted at their ends to the side sections of said stationary frame, a movable frame including spaced side sections, and at least some of said feed rolls and said presser roll and said conveyor roll being mounted at their ends to the side sections of movable frame with said movable frame being pivotably mounted to said stationary frame about a pivot offset from the center of gravity of said movable frame so that said movable frame is normally urged by gravity to move to its operating position with respect to said stationary frame where said rolls feed sheet material through said apparatus and apply glue to the sheet material and said movable frame can be lifted against the force of gravity to an open position where the rolls of said movable frame are spread apart from the rolls of said stationary frame for cleaning and the like, the improvement therein comprising a lock down assembly pivotably mounted on said stationary frame for holding said pivotable frame in its operating position, said lock down assembly comprising a shaft rotatably mounted at its end portions to the side sections of said stationary frame and including at each of its ends a lock leg with said lock legs extending normal to the length of said shaft and parallel to each other, said lock legs being pivotable with said shaft between positions where the ends of the lock legs engage the spaced side sections of said movable frame and hold said movable frame in its operating position with respect to said stationary frame and positions where the ends of the lock legs are out of engagement with the spaced side sections of said movable frame and the movable frame is pivotable with respect to said stationary frame, said lock legs each including extensible portions whereby the effective lengths of said lock legs are adjustable.

2. The invention of claim 1 and further including spring means connected between said shaft and said stationary frame whereby said lock legs are biased toward engagement with the side sections of said movable frame element.

3. The invention of claim 1 and wherein one of said lock legs includes hook means extending therefrom, and wherein the side section of said movable frame adjacent said hook means includes a catch element spaced from said hook means when said movable frame is in its operating position with respect to said stationary frame and movable into engagement with said catch element when said movable frame is pivoted away from its operating position with respect to said stationary frame.

4. The invention of claim 3 and further including spring means connected between said shaft and said stationary frame for biasing said lock legs toward engagement with the side sections of said movable frame element and for biasing said hook means toward engagement with said catch element.

5. In apparatus for applying glue and the like to sheet-like material comprising a stationary frame with spaced side sections and a movable frame with spaced side sections pivotably mounted on said stationary frame, a plurality of parallel rolls for feeding the sheet material along its length and applying glue to the sheet material, said rolls including a wetting roll and a glue applicator roll each mounted at their ends in the side sections of said stationary frame and a presser roll, a conveyor roll and feed rolls each mounted at their ends in the side sections of said movable frame, said movable frame being pivotable with respect to said stationary frame about a pivot offset from the center of gravity of said movable frame so that said movable frame is normally urged by gravity toward an operating position where said rolls feed sheet material through said apparatus and apply glue to the sheet material and so that said movable frame can be lifted against the force of gravity to an open position where the rolls of said movable frame are spread apart from the rolls of said stationary frame for cleaning and the like, the improvement therein of a lock down assembly comprising a shaft extending parallel to said rolls and rotatably mounted at its ends to the side sections of said stationary frame, lock legs mounted on the end portions of said shaft and extending normal to said shaft and parallel to each other and normally projecting from said shaft toward locking engagement with the side sections of said movable frame when said movable frame is in its operating position, spring means for urging said lock legs toward their locked positions, limit means for limiting the rotation of said lock down assembly toward its locked position with said movable frame, and said lock legs including extensible portions whereby the length of each lock leg is adjustable.

6. The apparatus of claim 5 and wherein said lock down assembly includes hook means for holding said movable frame in its open position.

7. An apparatus for applying glue and the like to sheet-like material comprising a stationary frame with spaced side sections, a first plurality of parallel rolls rotatably mounted at their ends in fixed relationship with respect to one another in the side sections of said stationary frame, a movable frame with spaced side sections pivotably supported with respect to said stationary frame, a second plurality of parallel rolls rotatably mounted at their ends in fixed relationship with respect to one another in the side sections of said movable frame, a lock down assembly comprising a shaft rotatably supported at its ends by the side sections of one of said frames and including lock legs movable into engagement with the side sections of the other of said frames to hold the rolls of the frames in predetermined positions with respect to one another, spring means for urging said lock legs toward their locked positions, limit means for limiting the rotation of said lock down assembly toward its locked position, and said lock down assembly includes means for holding said movable frame in its open position.

* * * * *